US009521895B2

(12) United States Patent
Stuart

(10) Patent No.: US 9,521,895 B2
(45) Date of Patent: Dec. 20, 2016

(54) SINGLE ACTION FOUR POINT HARNESS FOR A BACKPACK

(71) Applicant: Troy Stuart, Thornton, CO (US)

(72) Inventor: Troy Stuart, Thornton, CO (US)

( * ) Notice: Subject to any disclaimer, the term of this patent is extended or adjusted under 35 U.S.C. 154(b) by 69 days.

(21) Appl. No.: 14/494,918

(22) Filed: Sep. 24, 2014

(65) Prior Publication Data

US 2015/0129623 A1 May 14, 2015

Related U.S. Application Data

(60) Provisional application No. 61/903,277, filed on Nov. 12, 2013.

(51) Int. Cl.

| | |
|---|---|
| ***A45F 3/04*** | (2006.01) |
| ***A44B 11/25*** | (2006.01) |
| ***A45F 3/12*** | (2006.01) |

(52) U.S. Cl.

CPC ..... *A45F 3/04* (2013.01); *A44B 11/2549* (2013.01); *A45F 3/12* (2013.01); *A45F 3/047* (2013.01); *A45F 2003/122* (2013.01)

(58) Field of Classification Search

CPC ..... A44B 11/2549; A44B 11/2511; Y10T 24/45618; Y10T 24/45084; A45F 3/04; A45F 3/12; A45F 3/047; A45F 2003/122

See application file for complete search history.

(56) References Cited

U.S. PATENT DOCUMENTS

| | | | | |
|---|---|---|---|---|
| 3,639,948 A * | 2/1972 | Sherman | ..... | A44B 11/2542 24/632 |
| 4,646,400 A * | 3/1987 | Tanaka | ..... | A44B 11/2511 24/632 |
| 6,283,350 B1 | 9/2001 | Gottmeier et al. | | |
| 2007/0152007 A1 | 7/2007 | Kauss et al. | | |
| 2009/0094802 A1 | 4/2009 | Tishler | | |

FOREIGN PATENT DOCUMENTS

| | | |
|---|---|---|
| WO | WO-0154529 A2 | 8/2001 |
| WO | WO-2012030864 A2 | 3/2012 |

OTHER PUBLICATIONS

International Search Report and Written Opinion of International Application No. PCT/US2014/057223; Date of Mailing: Mar. 24, 2015; 12 pages.

* cited by examiner

*Primary Examiner* — Corey Skurdal
(74) *Attorney, Agent, or Firm* — Perkins Coie LLP

(57) ABSTRACT

A single action four point harness for a backpack that conforms to the anatomy of the wearer is provided. The backpack includes a storage section and a harness section. The harness section includes a plurality of pliable shoulder arms and a plurality of pliable waist arms that are bendable to conform to the anatomy of the wearer. The harness section also includes a buckle with a plurality of releasable fasteners. At least one fasteners is connected to each of the plurality of pliable shoulder arms and the plurality of pliable waist arms by an adjustable length strap. The buckle comprises a single release button and a plurality of individual release buttons to allow for releasing all of the fasteners from the buckle, using the single release button, or to allow for releasing individual fasteners from the buckle, using the individual release buttons.

6 Claims, 15 Drawing Sheets

SECTION A-A

SINGLE ACTION FOUR POINT HARNESS FOR A BACKPACK

CROSS-REFERENCE TO RELATED PATENT APPLICATIONS

The present application claims priority to U.S. provisional patent application Ser. No. 61/903,277, filed Nov. 12, 2013, the disclosure of which is incorporated herein by reference as if set out in full.

BACKGROUND

Backpacks have existed for several centuries, and they are ubiquitous today. Backpacks, over the course of history, have been called by a number of different names including the aforementioned backpack, but also rucksack, knapsack, sack, or even simply bag.

Originally, backpacks were little more than a sack having a plurality of loops, typically leather, through which a person's arms would fit such that the sack would be suspended by the straps and against the person's back. The sack may have a flap or be cinched to allow the sack to be open and closed.

Modern backpacks are very sophisticated as compared to the original backpacks described above. Modern backpacks are typically made from technical fabrics making them abrasion and water resistant as well as comfortable as the backpack can be padded where it contacts a body. Modern backpacks also are balanced and shaped to carry weight proportionally on the person to minimize stresses and the like. Still other features of modern backpacks include multiple and specially designed pockets and pouches for items, such as, for example, iPads, mobile phones, MP3 players, laptop computers, other handheld electronics, and the like. Backpacks may include wire channels or harnesses to allow wires to be routed through the backpack for earphones and power cords. In some cases, the backpack may have a frame or the like.

With the improvements in modern backpacks, backpacks have even replaced the briefcase for many people in the workforce. In other words, backpacks are used in personal and professional settings in the United States and throughout the world. However, despite the improvements, backpacks still suffer drawbacks and may be improved. For example, backpacks typically have loose straps that require adjustment to be worn comfortably. Additionally, the backpack may be unsecured across the front of the person or, at best, be secured by a chest strap and snap buckle, which may further inhibit the comfortable wearing of the backpack.

Against this background, it is desirous to develop improved backpacks.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

In one aspect, the technology of the present application comprises a backpack having a plurality of formable straps. A subset or all of the formable straps are releasably coupled to a single harness that allows for quick release and buckling.

In another aspect, the technology of the present application has a plurality of padded frame arms and a plurality of straps. The plurality of padded frame arms are pliable, such that they may bend with the application of force, and may be foldable. The padded frame arms being pliable allow the padded frame arms to be formed and shaped to match the anatomy of the wearer to facilitate comfortable wear.

The pliable padded frame arms, in at least one embodiment, may be retractable or foldable from a wear configuration to a storage configuration to facilitate storage of the backpack. The padded frame arms may, in this instance, fold over on themselves, pivot to a storage position, retract, or telescope into or onto themselves.

These and other aspects of the present system and method will be apparent after consideration of the Detailed Description and Figures herein.

DRAWINGS

Non-limiting and non-exhaustive embodiments of the technology of the present application, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

Figure 1:
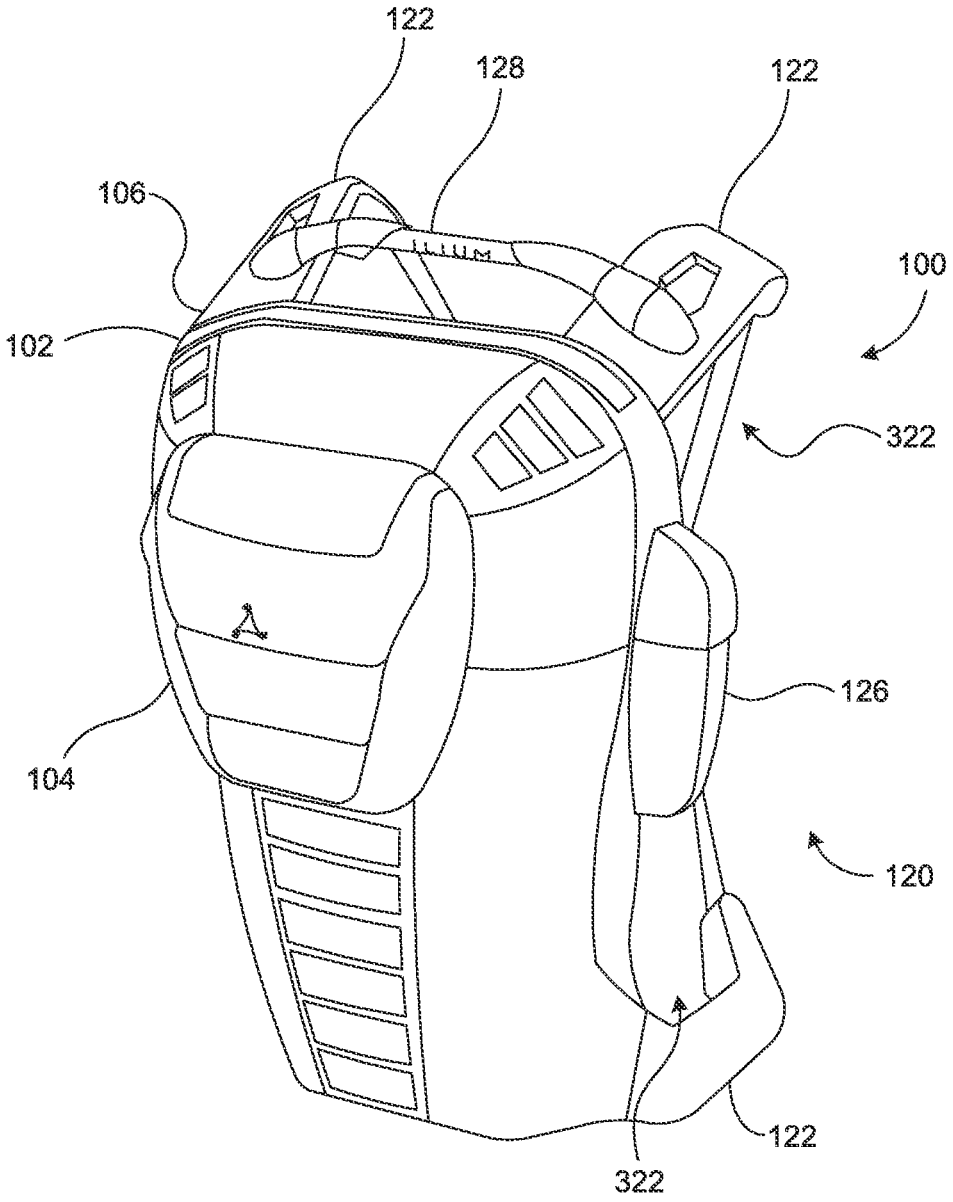
FIG. 1 depicts a back perspective view of a backpack incorporating the technology of the present application.
Figure 2:
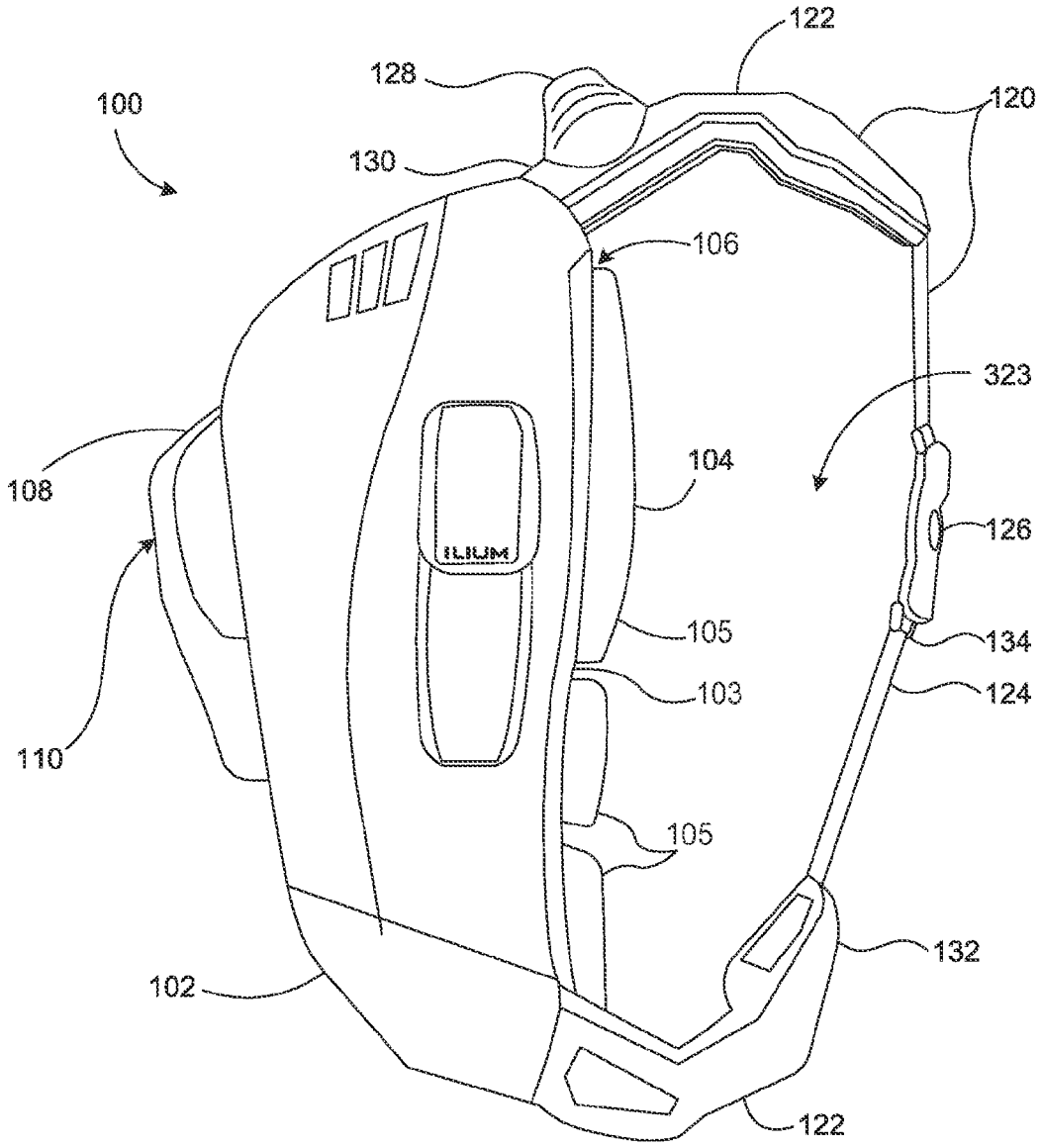
FIG. 2 depicts a side elevation view of the backpack of FIG. 1.

With reference now to FIGS. 1 and 2, a back perspective view (from the perspective of the wearer) and a side elevation view of a backpack 100 is shown. The backpack 100 comprises a storage section 102 and a harness section 120. The storage section 102 and the harness section 120 are integrally formed in the embodiment disclosed in FIG. 1. The harness section 120 includes, in this particular embodiment a bodyfacing wall 103 of the storage section 102, which bodyfacing wall 103 is the part of the backpack that generally touches the back of the wearer of the backpack. The bodyfacing wall 103 may include one or more paddings 105 (such as foam padding) for comfort.

The storage section 102 includes at least one, and typically a plurality of, pocket area 104 to store items for transport. The pocket area 104 may be selectively opened and closed by a zipper 106 in some cases or, in other cases, the pocket area 104 may be closable by a flap 108. The flap 108 may be secured by fasteners 110, such as, for example, a hook and loop fastener, snaps, or buckles. Zipper 106 also may be replaced by other equivalent means for closure, such as, for example, snaps, buckles, hook and loop material, zip locks, ties, etc.

The harness section 120 includes a plurality of padded frame arms 122, with a corresponding plurality of straps 124 connectable to a buckle 126, which is a single action buckle as will be explained further below. The plurality of padded frame arms 122 extend from the storage section 102 over pressure points on the body of the backpack wearer, such as, for example, over the shoulders or around the waist generally to the front torso area of a wearer. A hand grip strap 128 may extend from the left to the right side of the harness 120 to facilitate hand carrying of the backpack 100. The padded frame arms 122 may comprise a fabric layer over foam padding wrapped about metallic or composite pliable frame arms or simply a fabric layer over the metallic or composite pliable frame arms.

Figure 3:
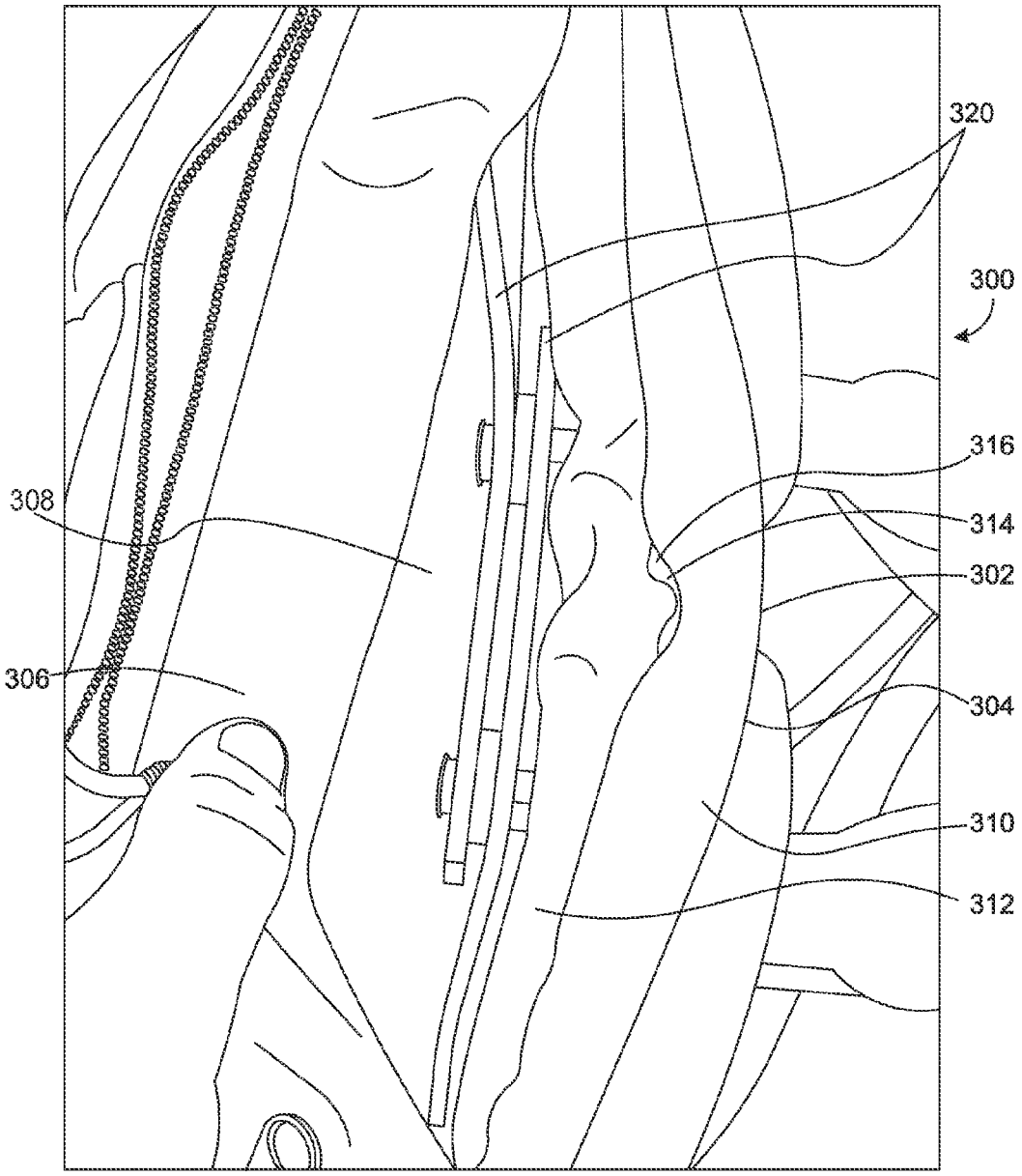
FIG. 3 depicts a view of a portion of the backpack of FIG. 1.

The harness portion 120 includes the plurality of padded frame arms 122. A single padded frame arm 300 is shown in FIG. 3. The single padded frame arm 300 is an exemplary embodiment of one of the plurality of padded frame arms 122. The padded frame arm 300 includes a sleeve member 302 made from a fabric, which may include woven or non-wovens. In this exemplary embodiment, the sleeve member 302 is formed of a synthetic fiber. The sleeve member 302 includes an exposed side 304 and a body side 306 forming a channel 308 between the exposed side 304 and the body side 306. In the present application, body side, bodyfacing, exposed, and the like are provided for reference and orientation relative to a wearer and should not be considered limiting. Each of the exposed side 304 and the body side 306 of the sleeve member 302 includes an external fabric 310 coupled to an internal fabric 312 forming a pocket 314 therebetween. The pocket 314 houses padding 316, which padding may be rubber, foam, or the like.

Figure 4:
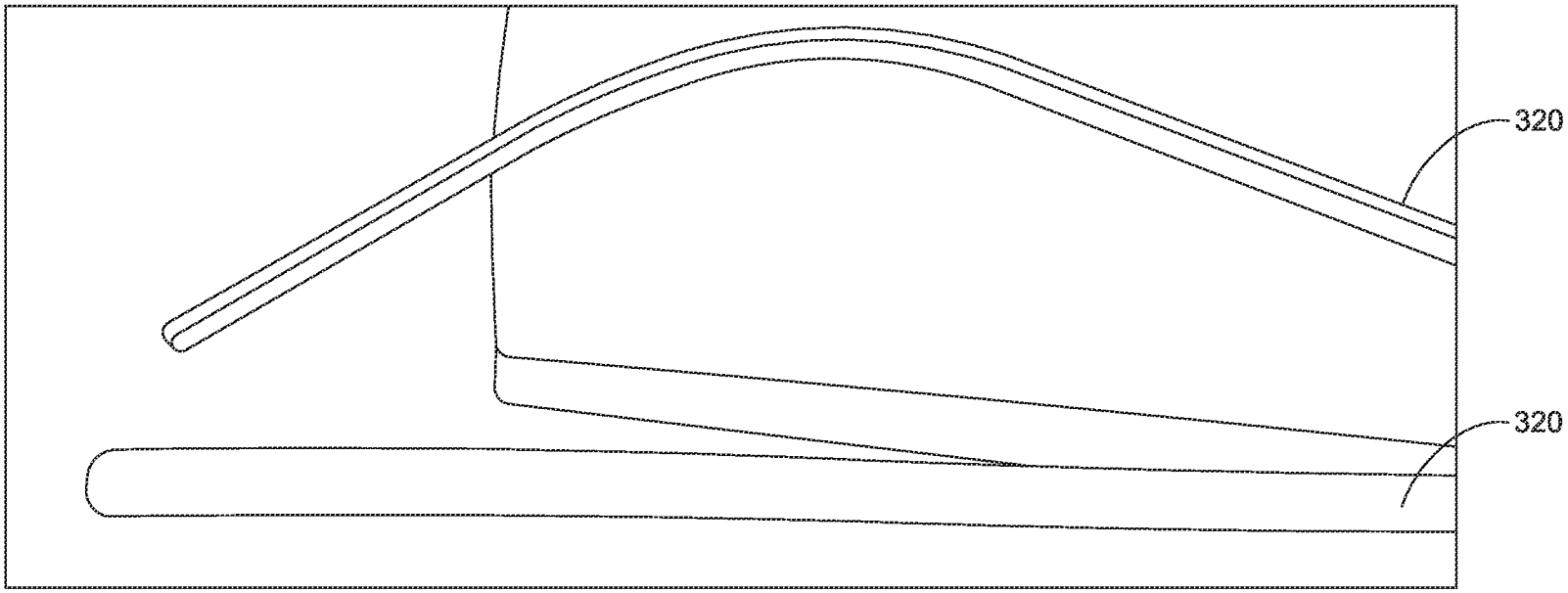
FIG. 4 depicts a view of the frame of the backpack of FIG. 1.

The padded frame arm 300 further includes a pliable frame member 320, which may be a single piece or a plurality of pieces coupled together as shown, which pieces are coupled using a plurality fasteners such as for example, bolts and washers, rivets, welds, adhesives, or the like. The pliable frame member 320 may be bent or shaped by the application of force, but generally maintains its shape under conventional loads associated with using the backpack. The force to bend pliable frame member 320 preferrably is no more than typical hand pressure that can be applied by the average person. Such metals include, without limitation, aluminum, nickel alloys, steels, carbon fiber, other composites, and the like. In operation, the pliable frame arm 300 having the pliable frame member 320 may be shaped or conformed to the anatomy of the person wearing the backpack such that the plurality of padded frame arms 122 along with the storage portion 102 of the backpack 100 form a cavity 322 (FIG. 1) that allows the padded arms to rest against the person snugly. This limits movement between the person and the harness, which should increase comfort and decrease, for example, chaffing or rubbing of the plurality of padded frame arms. The pliable frame member 320, removed from the sleeve etc. is shown in a side elevation view and a top elevation view in FIG. 4.

Figure 13:
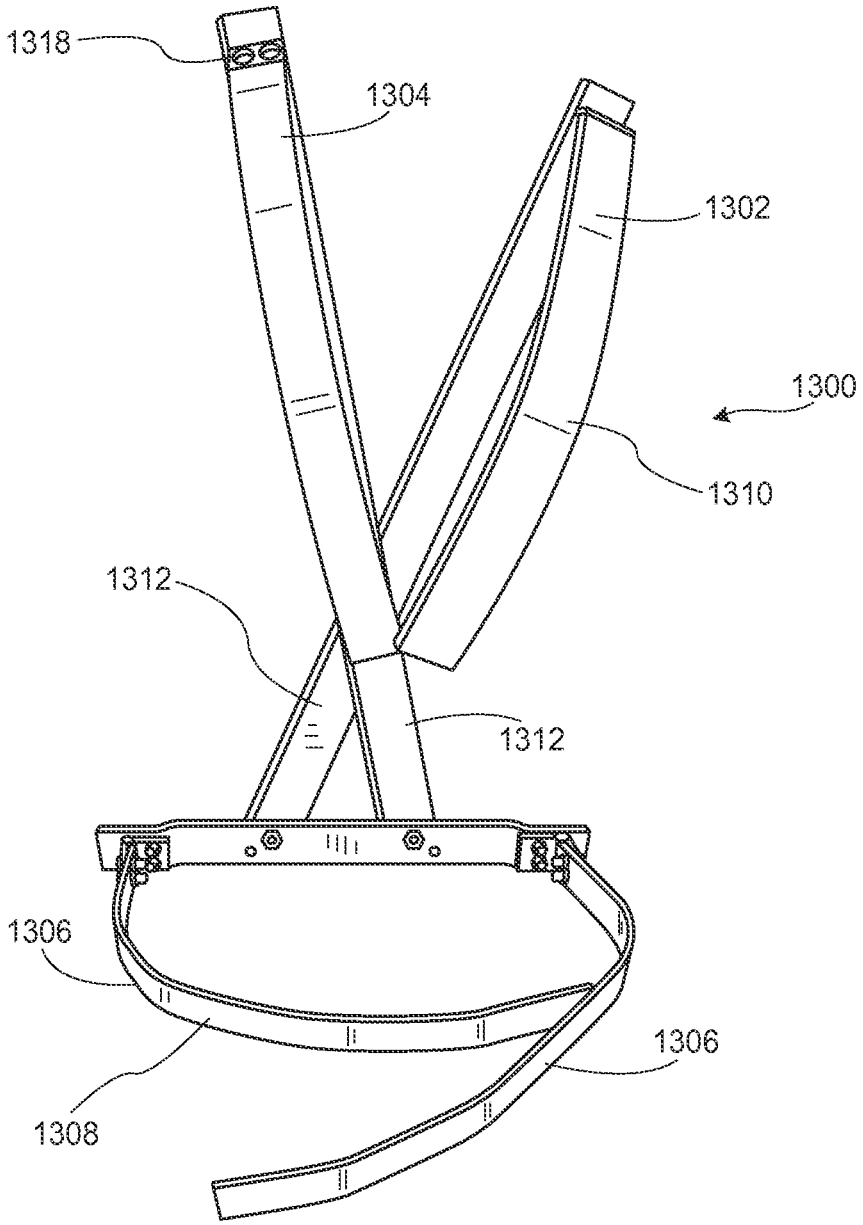
FIGS. 13 depicts a frame of a backpack consistent with the technology of the present application.
Figure 14:
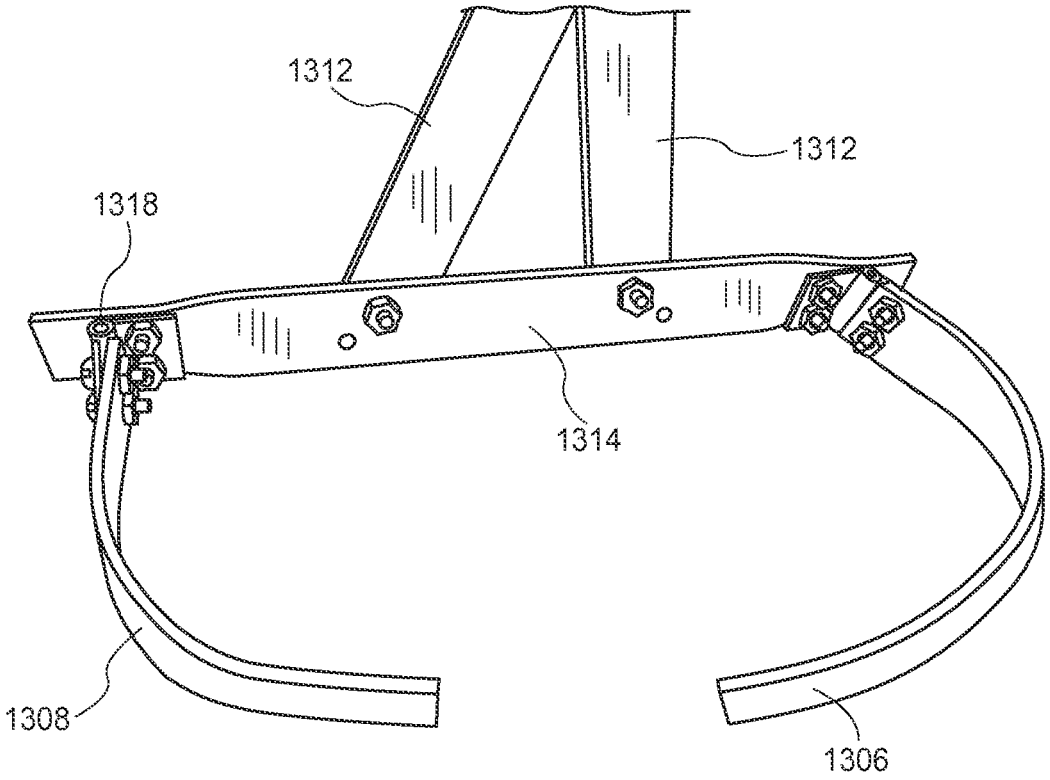
FIG. 14 depicts another view of the frame shown in FIG. 13.
Figure 15:
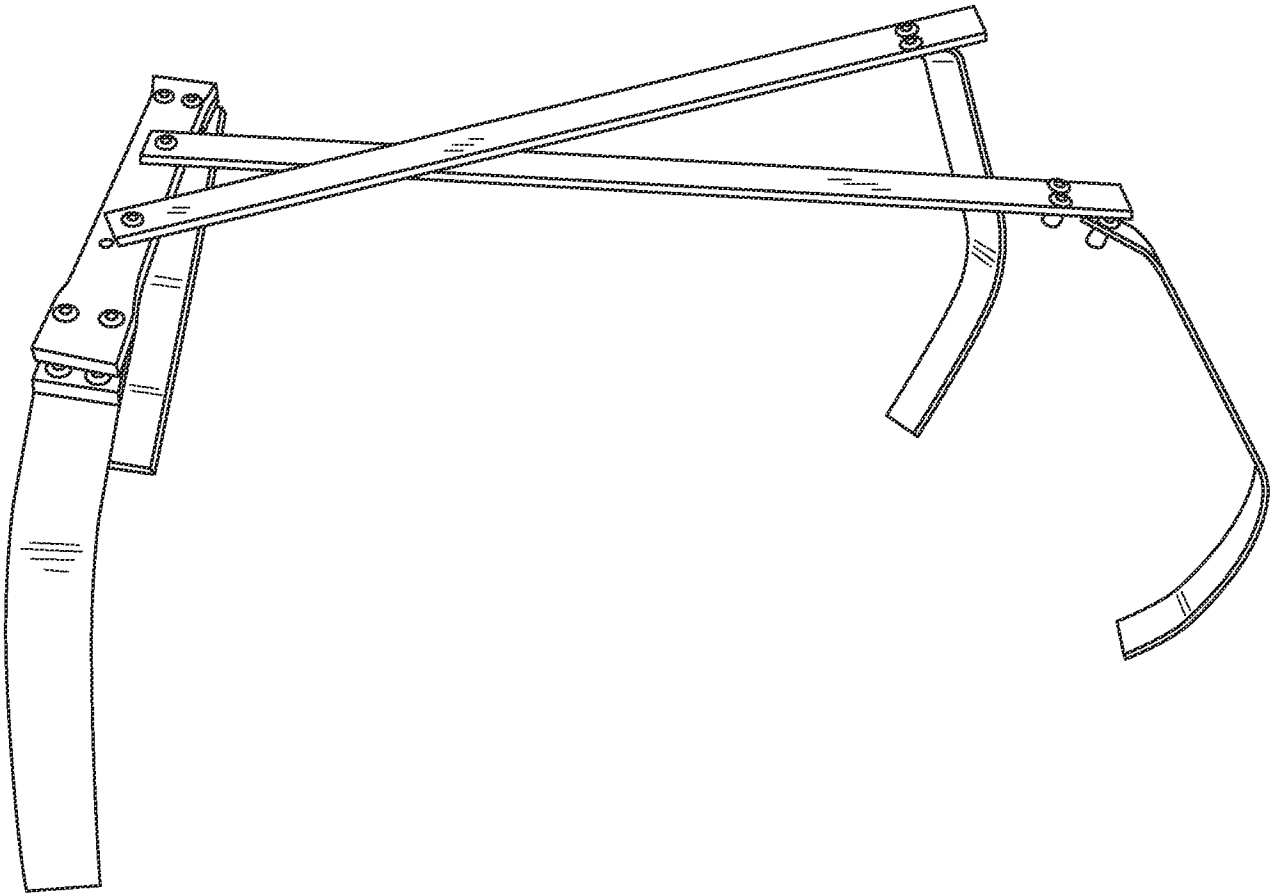
FIG. 15 depict still another view of the frame shown in FIG. 13.

As mentioned earlier, the plurality of padded frame arms 122 each comprise one or more pliable frame members 320 to facilitate shaping the backpack 100 to fit a particular body. The frame of the backpack 100 also may include, as mentioned above, mechanisms to allow the frame arms 122 to fold or retract. With specific reference to FIG. 13, for example, an exemplary metal frame 1300 for the backpack 100 is shown. The metal frame 1300 is shown without the fabric, pockets, padding, and the like for convenience. The metal frame 1300 includes pliable shoulder arms 1302, 1304 and pliable waist arms 1306, 1308. The pliable shoulder arms 1302 and 1304 have one or more bends 1310 that are shaped to conform to shoulder/neck anatomy for the comfort of the wearer when the backpack 100 is being worn. The metal frame 1300 also includes crossed vertical back support arms 1312 that extend from the pliable arms 1302, 1304 to a transverse brace 1314. The transverse brace 1314 would rest against the back, generally the lower or lumbar portion of the back, of the wearer. Extending from the transverse brace 1314 are waist arms 1306, 1308 that have one or more bends 1316 that are shaped to conform to the waist anatomy for the comfort of the wearer when the backpack 100 is being worn. In one embodiment, the frame members may be formed with hinges 1318 interspersed in the mechanism to allow the frame members to fold at that point. The hinge 1318 could be a conventional hinge, such as, for example, a piano hinge as shown, or a web of flexible material to allow the frame members to fold upon themselves. In other embodiments, the frame members may comprise telescoping sections that collapse into each other and have a latch to maintain the frame extended, such as a spring loaded pin or ball and detent. In FIG. 13, the pliable shoulder arms 1302, 1304 are shown folded to a stowage configuration whereas in FIG. 15, the pliable shoulder arms 1302, 1304 are shown folded (or unfolded) to a wear configuration. With reference to FIGS. 13 and 14, the pliable shoulders 1302, 1304 and the pliable waist arms 1306, 1308 are shown as pivotally coupled to the vertical braces 1312 or the transverse brace 1314, respectively, by a fastener 1318, which is a hinge 1318 in this exemplary embodiment. In certain embodiments, the pliable shoulder arms 1302, 1304 and waist arms 1306, 1308 may be fixedly coupled to the vertical braces 1312 or the transverse brace 1314. In these cases, the pivot point, or hinge 1318 may be placed between two portions of the pliable arms to allow folding between the wear configuration and the stowage configuration. The metal frame shown in FIGS. 13-15 may be abrasive to the foam or fabric material of the backpack 100. Thus, the metal frame may have a shield material or a plurality of shield materials, such as a plastic sheet, placed between the metal frame and the foam or fabric at high stress points, such as, for example, edges, corners, hinge points, or the like, to reduce wear on the backpack 100.

Each of the plurality of padded frame arms 122 has a proximal end 130 and a distal end 132. The proximal end 130 is connected to the storage portion 102 and the distal end 132 is opposite the proximal end 130. A plurality of straps 124 are coupled to the distal ends 132. Typically there is one strap for each of the plurality of padded frame arms 122. The plurality of straps 124 are fixedly coupled, such as by a stitch, to the distal end 132 of each of the plurality of padded frame arms 122 and extend from the distal end 132 to a fixture 134, which will be explained further below. In the present exemplary embodiment, each of the fixtures 134 are removably coupled to the buckle 126; although, in alternative embodiments, one or more of the straps could terminate at the buckle 126 rather than the fixture 134. One or more of the straps has an adjustable length, which provides an adjustable length strap as is generally known in the art and will not be further explained herein except as necessary.

Figure 5:
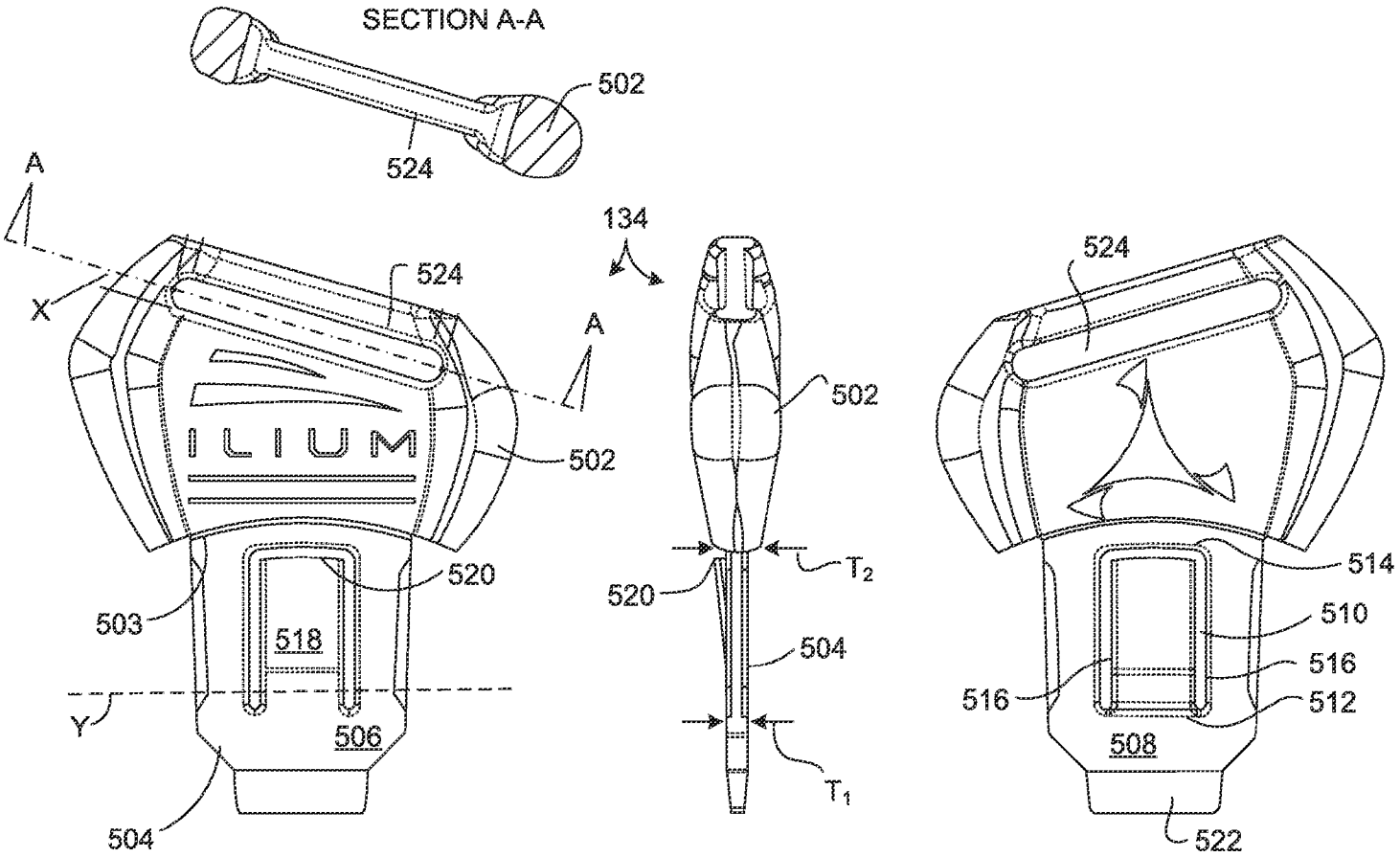
FIG. 5 depicts a view of the fixture of the backpack of FIG. 1.
Figure 6:
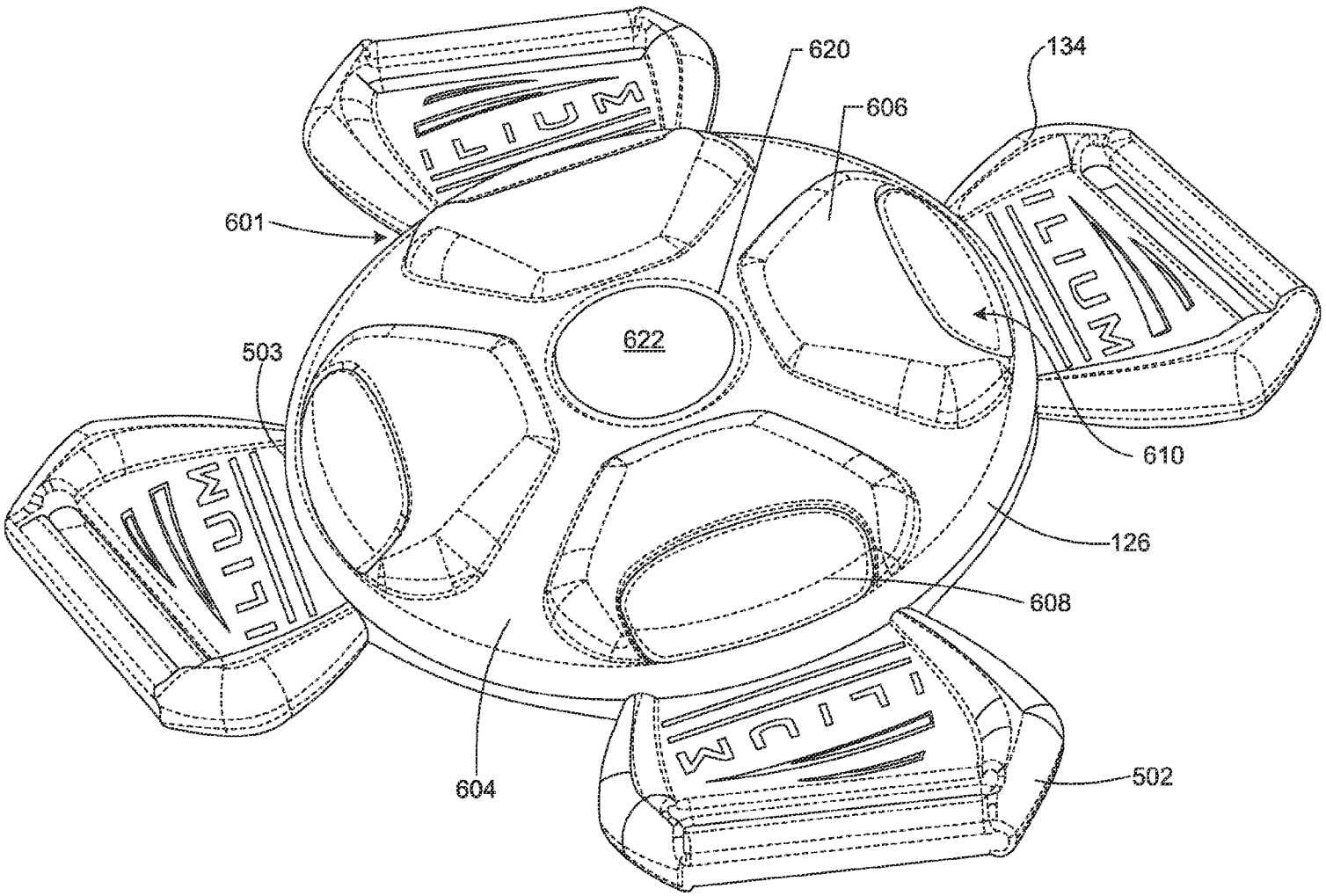
FIG. 6 depicts a perspective view of the buckle of the backpack of FIG. 1.
Figure 7:
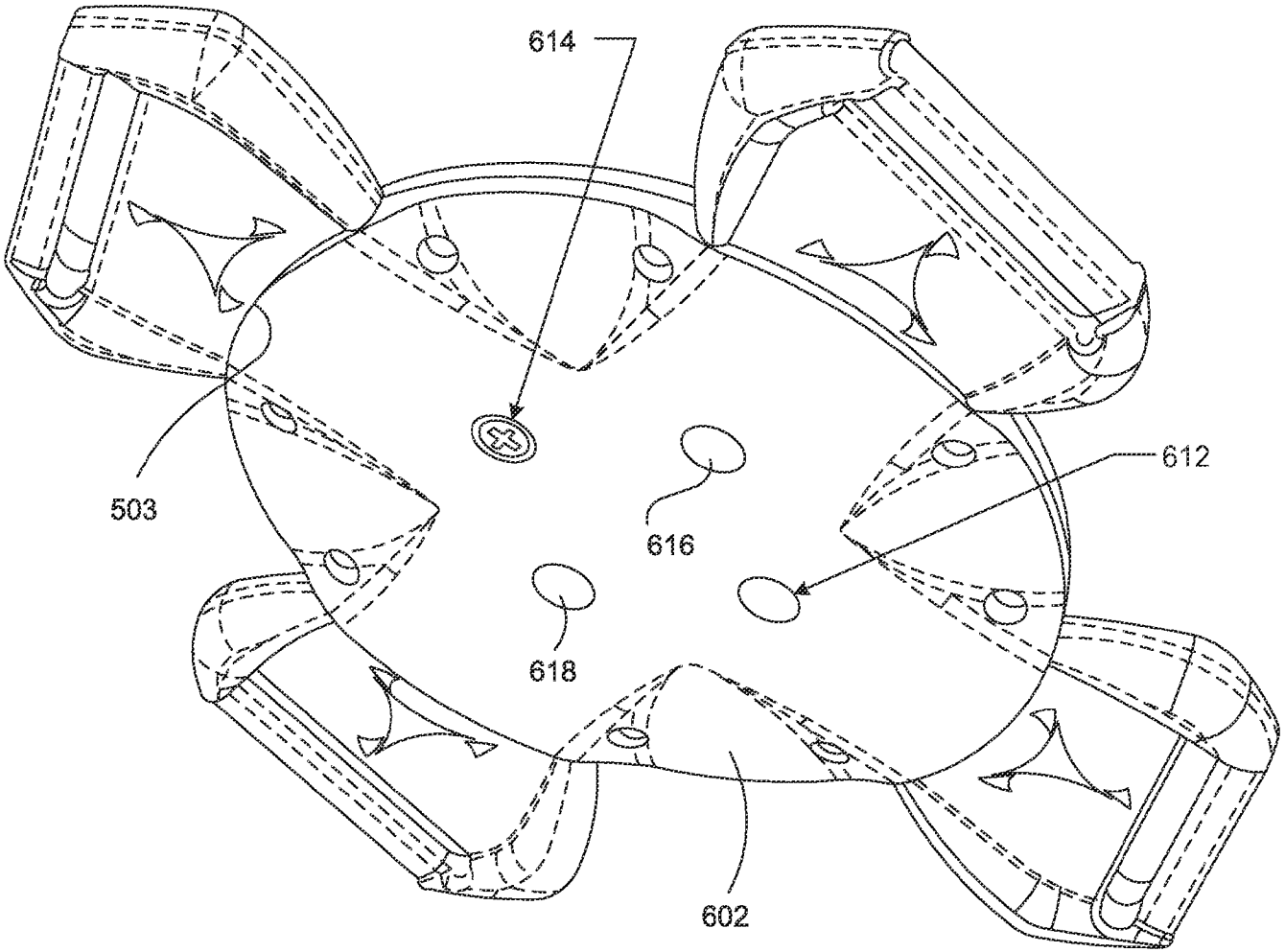
FIG. 7 depicts another perspective view of the buckle of the backpack of FIG. 1.

With reference now to FIG. 5, a fixture 134 is shown. The fixture 134 comprises a base 502 and a male protrusion 504 extending from the base 502. The base 502 has an internal wall 503 that is shaped to operatively couple with the shape of the buckle 126. Thus, as the buckle 126 in the exemplary embodiment is circular, the internal wall 503 is arcuate or curved to sit flush with the buckle 126. The male protrusion 504 has a thickness $T_1$ that is less than a thickness $T_2$ of the base 502, at least at the internal wall 503, such that the internal wall 503 forms a stop surface to inhibit over inserting the fixture 134 into the female socket of the buckle 126, explained further below. The male protrusion 504 has an outward facing surface 506 and an inward facing surface 508 (from the perspective of a wearer, which surfaces may be referred to as top and bottom respectively for convenience). A bore 510 exists in the male protrusion 504 having a leading edge 512, a trailing edge 514, and a pair of side edges 516 defining an area A. A flexible tab 518 is coupled to the leading edge 512 and tapers upwards or away from the outward facing surface 506 to a lock surface 520 or end of the flexible tab 518. The flexible tab 518 flexes into the bore 510 on insertion of the fixture 134 into the buckle 126. Once fully inserted, the flexible tab 518 returns partially or fully to the shown unbiased position such that the lock surface 520 abuts a corresponding feature in the buckle (such as an inner wall of the female socket) to inhibit the fixture 124 from being removed. The male protrusion 504 may comprise a leading tongue 522 that is chamfered or beveled to facilitate aligning the male protrusion 504 with the female socket of the buckle.

The base 502 of the fixture 134 comprises a slot 524. The slot 524 defines a line X that is oblique to a transverse axis Y of the male protrusion 504. The slot 524 for each fastener is coupled to the plurality of straps 124 such that the strap extends from the distal end 132 to the fixture 134. The slot 524 is angled or arranged such that the strap 124, extending between the padded frame arm and the buckle, does not twist and is flat against the torso of the person wearing the backpack. The angle may be between about 5 and 45 degrees, but is preferably between about 10 to 20 degrees. In the exemplary embodiment, the angle is approximately 16 degrees. In this specific context, approximately 16 degrees means within a manufacturing tolerance.

The buckle 126 will now be explained in detail with reference to FIGS. 6-12. A perspective outward facing view 600 of the buckle 126 is shown with four fixtures 134 attached to the buckle 126 in FIG. 6. The buckle 126 has a base plate 602 (best seen in FIGS. 7, 11, and 12) and a cover 604 (best seen in FIGS. 6, 11, and 12). The buckle 126 is shown circular in shape but could comprise other shapes, such as square, rombus, trapezoidal, elliptical, or the like. Also, the buckle 126 is designed to attached to four fixtures 134 such that two shoulder points of contact and two waist points of contact provide increased stability for the backpack 100 in relation to the torso of the person wearing the backpack 100. The buckle 126 and the backpack 100 may be formed with more or less fixtures 134. The internal wall 503 of the base 502 is shown as flush with the cover 604 and base plate 602. Arranged about the buckle 126 where the fixtures 134 are attached are female sockets 601 to receive the mail protrusions 504 of the fixtures 134. The female sockets are formed by a recess 1108 in the cover 604 and the base plate 602. The female sockets, however, may be formed by bores or openings in the cover 604 or the base plate 602.

Figure 10:
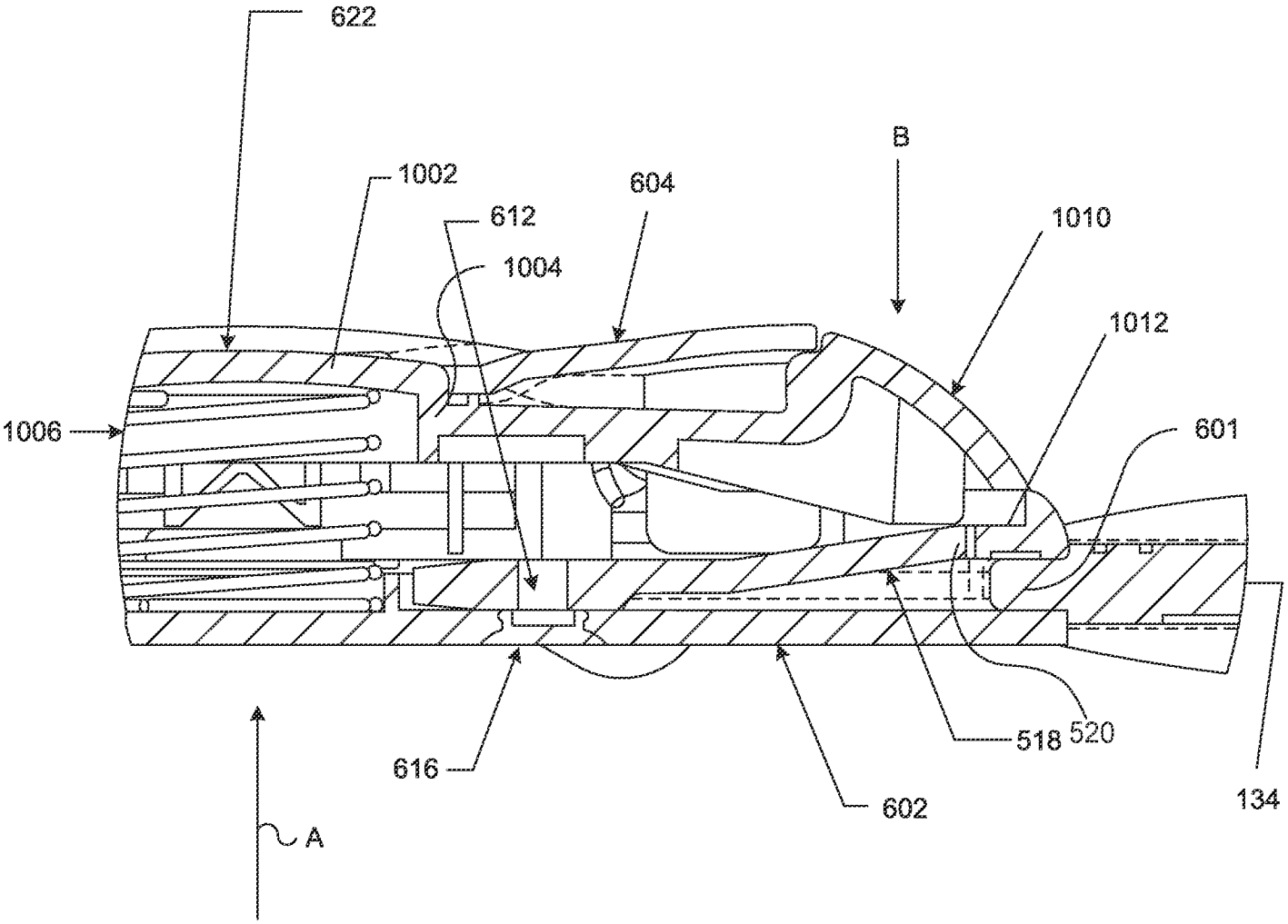
FIG. 10 depicts a detailed view of a portion of the cross section of FIG. 9.

The cover 604 includes a plurality of bulges 606 aligned with the fixtures 134. The bulges 606 are aligned with the male protrusion 504 and provide an opening 608 to the interior 610 defined by the bulges 606. The flexible tab 518 (as shown in FIG. 10) is exposed through the opening 608 such that the flexible tab 518 may be depressed to individually release a fixture 134.

The base plate 602 is coupled to the cover 604. The coupling could be via screws, as shown, a snap fitting, a friction fitting, a taper lock, or a threaded connection. The base plate 602 includes a plurality of lock bores 612 and a lock screw 614. Although all the fixtures 134 may be releasably coupled to the buckle 126, the lock screw 614 inhibits one or more fixture 134 from being releasably coupled to the buckle 126. This inhibits inadvertently misplacing or losing the buckle 126 if all the fixtures 134 are released. Alternative to the lock bores 612 and the lock screw 614, one fixture 134 may be permanently fixed to the buckle. Plugs 616 or caps 618 may be placed in the lock bores 612 not being used by the lock screw 614.

The cover 604 also includes a bore 620, shown located generally at a geometric center C of the buckle 126. A spring loaded release button 622 is aligned with the bore 620 and actuatable by a wearer of the backpack or other person as will be explained further below.

Figure 8:
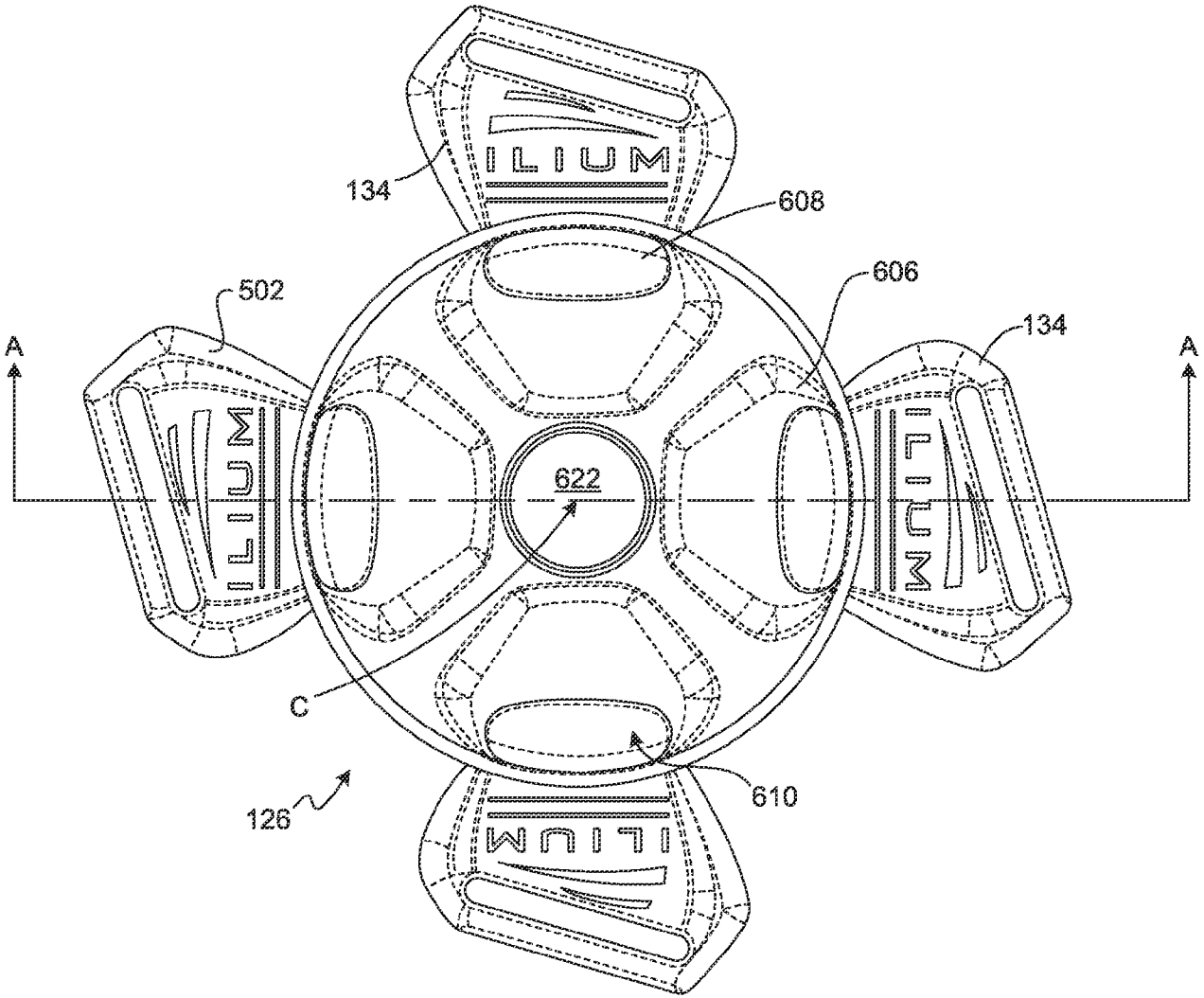
FIG. 8 depicts a plan view of the buckle of the backpack of FIG. 1.

With reference to the top plan view of the buckle 126, shown in FIG. 8, the orientation of the fixtures 134, buckle 126, and spring loaded release button 622 about the geometric center C of the buckle 126 is shown. As can be appreciated, the buckle 126 is shown as symmetrical to facilitate centering the buckle on the torso. The buckle 126 may be asymmetrically shaped, however.

Figure 9:
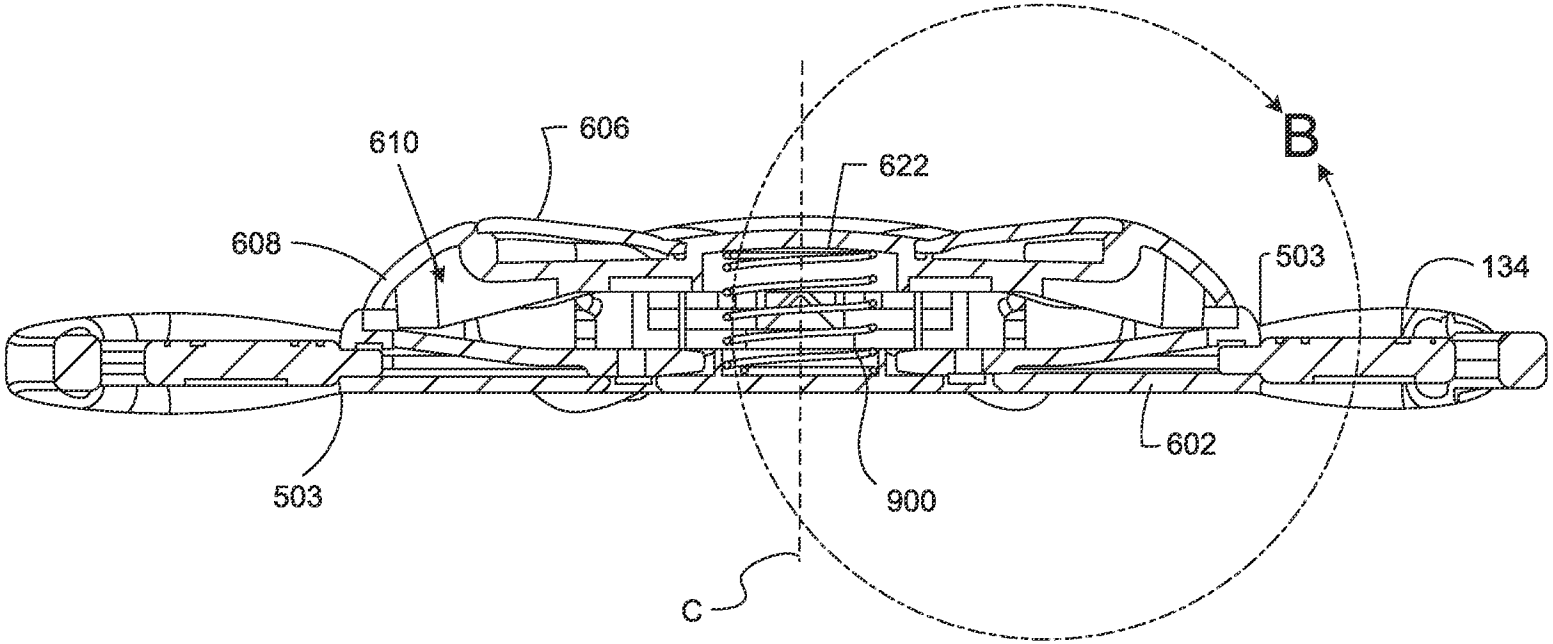
FIG. 9 depicts a cross-sectional view of the buckle of the backpack of FIG. 1.

FIG. 9 shows a cross sectional view of the buckle 126 with fixtures 134 attached thereto. FIG. 10 shows the cross sectional view of the buckle 126 and fixture 134 in more detail. The spring loaded release button 622 has a top surface 1002 and descending sidewalls 1004 forming a cylindrical cavity 1006 into which a spring 900 extends. The spring 900 could be any elastic compression member that tends to push the spring loaded release button 622 in a direction A. Extending radially outward from the descending sidewalls 1002 are a plurality of release arms 1008 terminating in individual release buttons 1010. The individual release button 1010 is sized to fit into and/or fill the opening 608. Each of the plurality of individual release arms 1008 are moveable, at least in the direction B, such that pressure on the individual release button 1010 will cause the individual release arms 1008 to move in a descending direction. Otherwise, the individual release arms 1008 move in cooperation with the spring loaded release button 622. In FIG. 10, the lock bore 612 does not contain a lock screw 614, but rather a plug 616, which allows the individual release arms 1008 to move with the spring loaded release button 622. If the lock bore 612 contained the lock screw 614, however, the lock screw would extend into the bore and abut the individual release arm 1008 to inhibit movement of the individual release arm 1008 in the direction B to inhibit the release of the particular fixture 134.

As best seen in FIG. 10, the lock surface 520 of the flexible tab 518 engages a latch plate 1012 of the buckle 126. The latch plate 1012 is a flanged surface extending radially inward from the cover 604. When the lock surface 520 and the latch plate 1012 are engaged, the fixture 134 is inhibited from being removed from the buckle 126. While many features of the device are shown as integral with other features, the manufacturing methods may require various pieces to be separate and integrated using fasteners. For example, the latch plate 1012 is shown integral with the buckle 126. The latch plate 1012 may be, for example, a separate piece fastened with the base plate 602 rather than integral with the dome 604.

Figure 11:
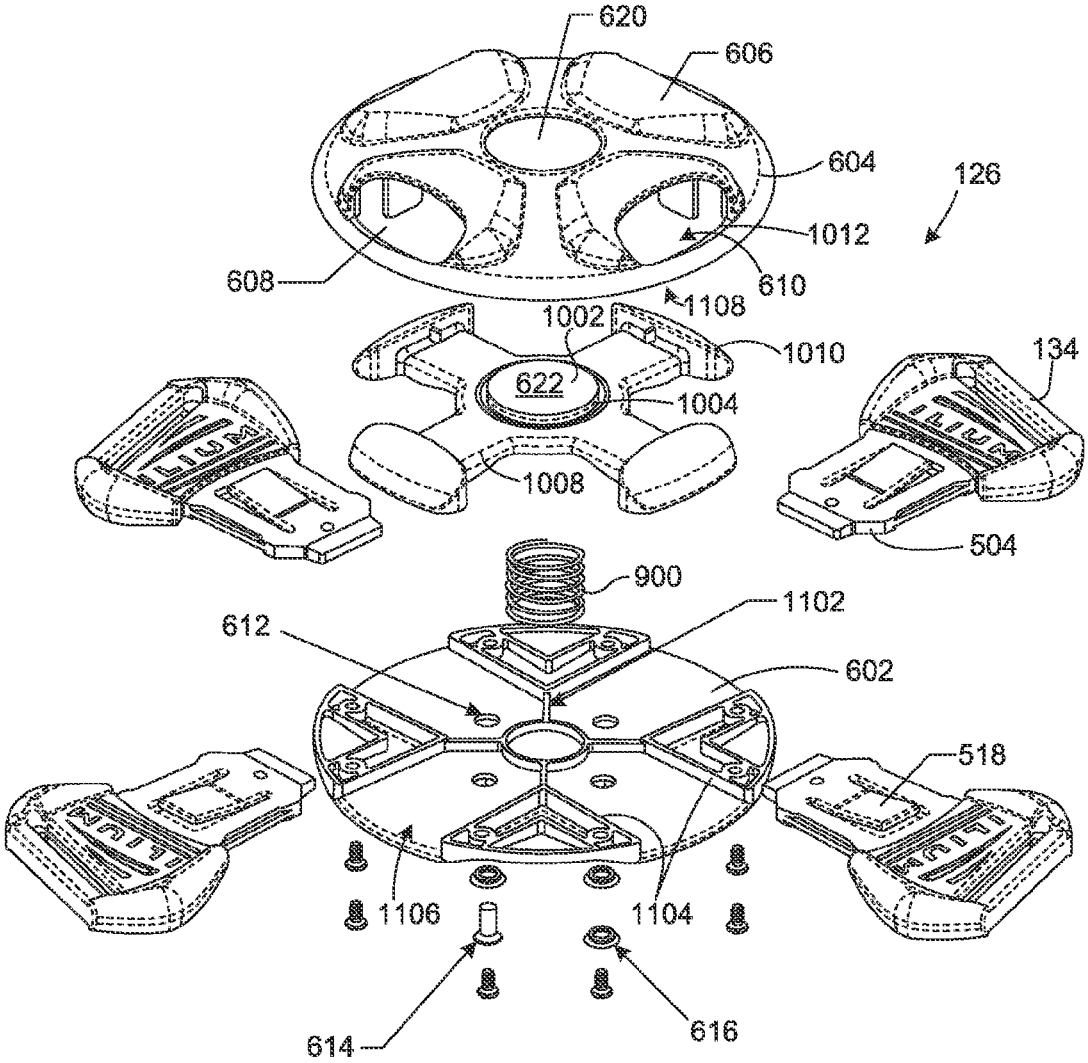
FIG. 11 depicts an exploded perspective view of the buckle of the backpack of FIG. 1.
Figure 12:
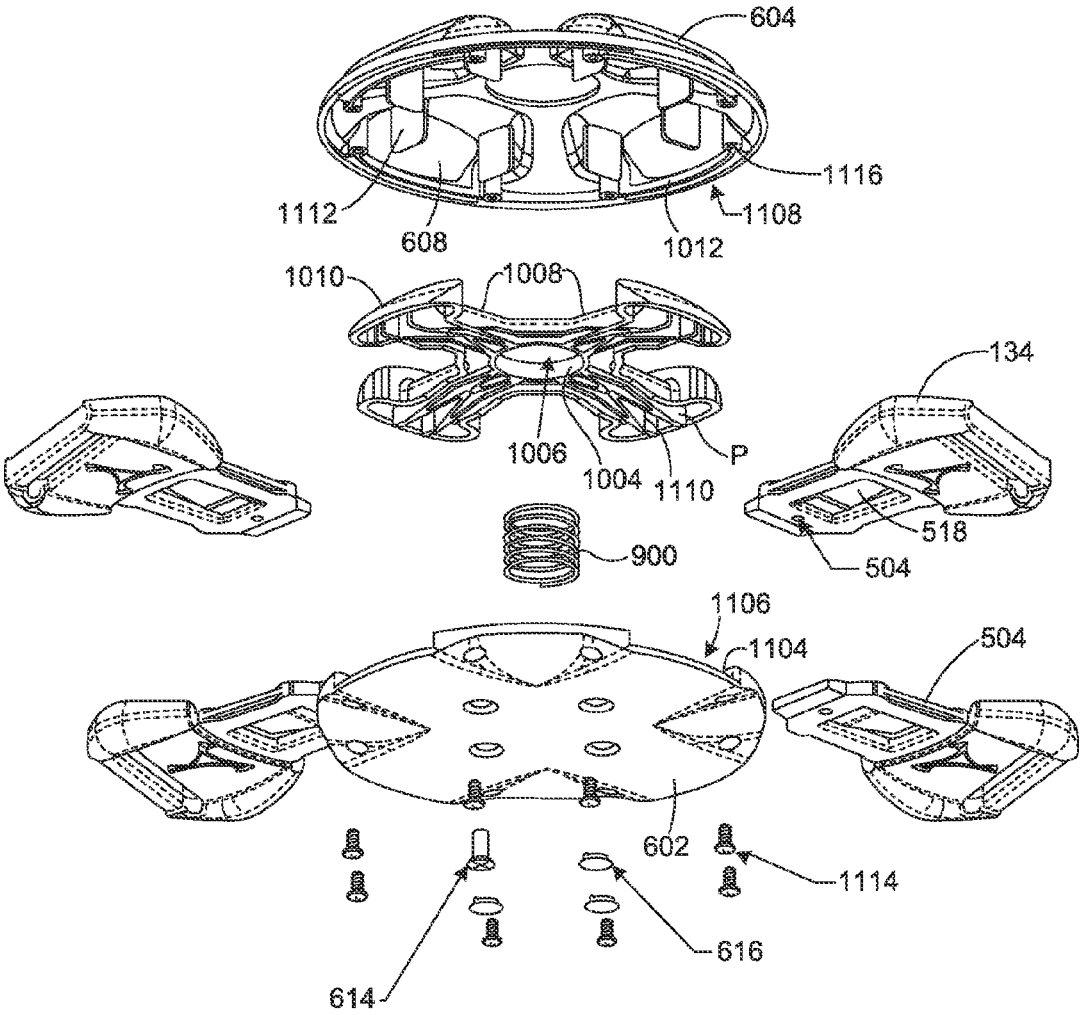
FIG. 12 depicts another exploded perspective view of the buckle of the backpack of FIG. 1.

Additional details of the buckle 126 are further provided by the exploded views of the buckle 126 shown in FIGS. 11 and 12. For example, in certain embodiments, the base plate 602 may include one or more rib 1102, which may increase the strength of the base plate 602. Additionally, ascending walls 1104 may be provided to form alignment channels 1106 to receive the male protrusions 504 of the fixtures 134. Also, instead of being solid, the individual release arms and buttons 1008, 1010 may be hollow with descending ribs 1110. Also, the cover 604 may have support columns 1112 extending from the cover 604 to abut the base plate 602 to provide compression resistance. Finally, the cover 604 and base plate 602 may be coupled by threading screws 1114 into anchors 1116.

As can be appreciated with reference to the figures, the first time backpack 100 is worn by an individual, the plurality of padded frame arms 122, which include the pliable frame member 320, are formed to conform to the person. In other words, the pliable shoulder arms 1302, 1304 and the pliable waist arms 1306, 1308 are bent for comfort of the wearer. The fixtures 134 are then coupled to the buckle 126 by inserting the male protrusion 504 into the female socket 601. The flexible tab 518 is deflected downward by the cover 604 to allow the male protrusion 504 to move into the female socket 601. Once the flexible tab 518 is inserted beyond the latch plate 1012, the flexible tab 518 returns to or at least towards its non-deflected position such that the lock surface 520 and the latch plate 1012 are engaged. This may be accompanied by an audible click or the like. Three or four fixtures 134 are connected. Three, if one of the fixtures is prelocked to the buckle using the lock screw 614 or a permanent coupling of the fixture and the buckle. If four fixtures 134 are inserted, optionally, the lock screw 614 may be threaded into the lock bore 612.

To individually release fixtures 134 from buckle 126, the individual release button 1010 associated with that fixture 134 is depressed. The depression causes the individual release button 1010 (or a descending rib 1110) to engage the top surface of the flexible tab 518 and deflects it downward until the lock surface 520 disengages with the latch plate 1012. The flexible tab 518 is biased upwards such that the force of the flexible tab 518 trying to return to the undeflected position tends to push the fixture radially outward such that the male protrusion tends to leave the female socket when disengaged.

To simultaneously release multiple fixtures 134, the spring loaded release button 622 is depressed. All of the interconnected individual release arms 1008 move in conjunction with the depression of the spring loaded release button 622. The descending ribs 1110, for example, engage the plurality of flexible tabs 518 to allow release. For the simultaneous release, if the lock screw 614 is in place, one of the plurality of individual release arms 1008 will not move on depression of the spring loaded release button 622.

Although the technology has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

I claim:

1. A single action multiple point harness for a backpack, comprising:

a buckle comprising a cover and the cover comprises at least one bulge defining an interior and a latch plate resides in the interior of the bulge such that the flexible tab of the releasable fixture abuts the latch plate when the fixture is locked to the buckle, and a plurality of fixtures wherein at least some of the plurality of fixtures are releasably coupled to the buckle, wherein the buckle comprising:

a cover and the cover comprises at least one bulge defining an interior and a latch plate resides in the interior of the bulge;

a plurality of sockets positioned on the buckle corresponding to the plurality of fixtures;

a single release button movably coupled to the buckle;

a compression member biasing the single release button in a first direction;

a plurality of release arms coupled to the single release button, wherein the plurality of release arms correspond to the at least some of the plurality of fixtures that are releasably coupled to the buckle wherein the plurality of release arms move in a second direction when the single release button is actuated releasing the releasably coupled fixtures from the buckle;

each of the at least some of the plurality of fixtures that are releasably coupled to the buckle comprising:

a base having a slot connectable to a strap; and a male protrusion extending from the base sized to cooperatively engage the socket on the buckle, the male protrusion having a flexible tab coupled to the male protrusion, wherein the flexible tab is movable by the release arm from a locked position where the fixture is locked to the buckle to an unlocked position to release the releasably coupled fixture from the buckle such that the flexible tab of the releasable fixture abuts the latch plate when the fixture is locked to the buckle, wherein the plurality of release arms each terminate in an individual release button that resides in the interior and wherein the individual release button is moveable individually and independently of the single release button and wherein the individual release button moves the flexible tab away from the latch plate to release the fixture.

2. The single action multiple point harness of claim 1 wherein the plurality of fixtures comprise four fixtures.

3. The single action multiple point harness of claim 1 wherein all of the plurality of fixtures are releasably coupled to the buckle and wherein one of the plurality of fixtures is inhibited from being released by a lock member coupled to the buckle.

4. The single action multiple point harness of claim 1 wherein each of the plurality of fixtures comprises a slot connectable to a strap, wherein the slot is arranged at an oblique angle to a transverse axis of the male protrusion.

5. The single action multiple point harness of claim 4 wherein the oblique angle is between 10 and 20 degrees.

6. The single action multiple point harness of claim 5 wherein the oblique angle is approximately 16 degrees.

* * * * *